United States Patent [19]

Drucker

[11] 4,016,675

[45] Apr. 12, 1977

[54] PUSH TOY

[76] Inventor: Howard Drucker, 35 Great Rock Road, Sherbon, Mass. 01770

[22] Filed: Oct. 17, 1975

[21] Appl. No.: 623,560

Related U.S. Application Data

[63] Continuation-in-part of Ser. No. 535,214, Dec. 23, 1974, Pat. No. 3,940,881.

[52] U.S. Cl. ..... 46/205

[51] Int. Cl.[2] ..... A63H 17/36

[58] Field of Search ..... 46/220, 114, 234, 235, 46/238, 241, 205

[56] References Cited

UNITED STATES PATENTS

| | | | |
|---|---|---|---|
| 1,171,972 | 2/1916 | Myers | 46/235 X |
| 1,596,200 | 8/1926 | McLaren | 46/114 X |
| 1,911,392 | 5/1933 | Redmond | 46/234 |
| 1,969,407 | 8/1934 | Kingsburg | 46/220 |
| 2,647,343 | 8/1953 | Lileri et al. | 46/220 |
| 2,842,896 | 7/1958 | Sire | 46/238 |
| 3,169,345 | 2/1965 | Marmo et al. | 46/241 |

*Primary Examiner*—Louis G. Mancene
*Assistant Examiner*—Robert F. Cutting
*Attorney, Agent, or Firm*—Morse, Altman, Oates & Bello

[57] ABSTRACT

A push toy for use by children which can be pushed and steered and which upon its front end includes a bumper having an electromagnet for magnetically attracting a magnetically cooperative member on a rear of a toy vehicle so that the vehicle can be pushed into different directions, and the electromagnet being manually controlled by a push button located near a steering wheel. The push toy magnetically cooperates with a removable toy for holding the removable toy on the push toy.

11 Claims, 5 Drawing Figures

PUSH TOY

CROSS-REFERENCE TO RELATED APPLICATIONS

This application is a continuation-in-part of my pending application Ser. No. 535,214 filed on Dec. 23, 1974 now U.S. Pat. No. 3,940,881, Mar. 2, 1976.

BACKGROUND AND SUMMARY OF THE INVENTION

This invention relates generally to push toys.

A principal object of the present invention is to provide a push toy which enables a child to steer while walking upright.

Another object of the present invention is to provide a push toy which may be made in various sizes so as to suit different age groups of children.

A further object of the present invention is to provide a push toy which is adapted to magnetically engage toy vehicles in front thereof so that the toy vehicles can be pushed into any desired direction.

A still further object of the invention is to provide a push toy which magnetically cooperates with a removable toy for holding the removable toy on the push toy.

Other objects are to provide a push toy which is simple in design, inexpensive to manufacture, rugged in construction, easy to use and efficient in operation.

These and other objects of the present invention will in part be obvious and will in part appear hereinafter.

The invention accordingly comprises the devices, together with their components and interrelationships, that are exemplified in the folowing disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
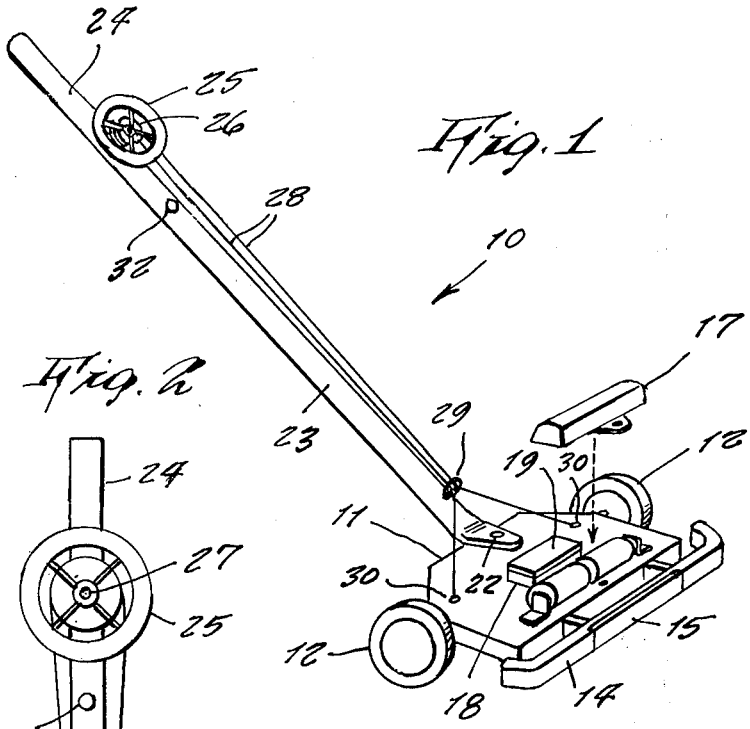
FIG. 1 is a perspective view of the present invention and showing a cover for enclosing the batteries, shown removed.
Figure 2:
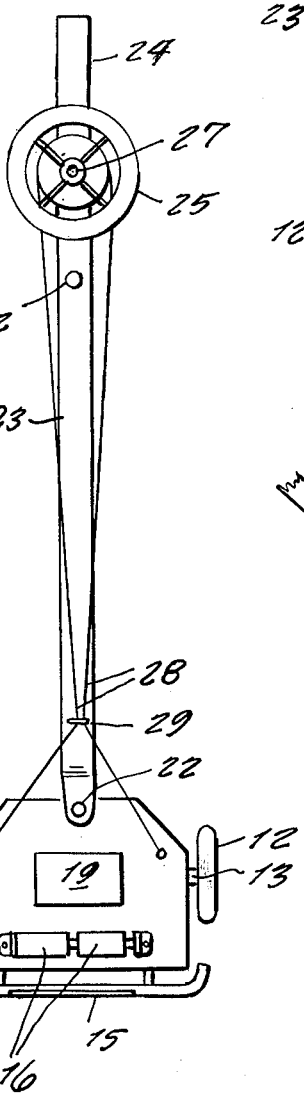
FIG. 2 is a top front view of and shown including the batteries exposed.
Figure 3:
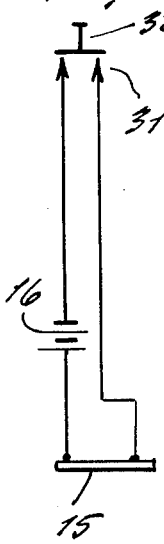
FIG. 3 is an electrical circuit of the invention.

Referring now to the drawing in detail, the reference numeral 10 represents a push toy according to the present invention wherein there is a carriage 11 that is mounted upon a pair of side wheels 12 rotatable about axles 13 that are axially aligned and secured to the carriage 11. Upon a front end of the carriage there is front bumper 14 which at its center has an electromagnet 15 built into it, the electromagnet 15 being electrical circuit with a pair of dry cell batteries 16 mounted on top of the carriage 11 and which are protectively enclosed under a removable top cover 17 that allows the batteries to be replaced. Additionally the circuit includes a push button switch 31 to be described later, and which serves to open and close the circuit.

Figure 5:
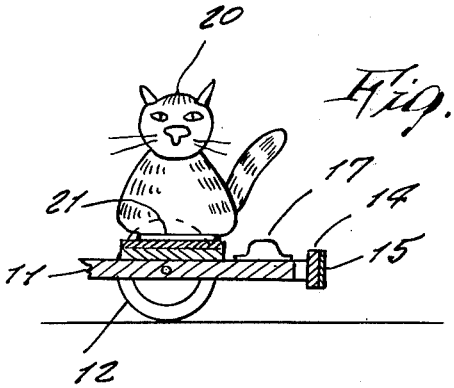
FIG. 5 is a fragmentary side cross-sectional view of the carriage of the push toy and showing a removable toy placed mounted thereon.

Also on top of the carriage 11 there is mounted a bar 19 which magnetically cooperates with a base 21 of a removable toy 20 for holding the removable toy on the carriage. One of bar 19 and one of holding the removable toy on the carriage. One of bar 19 and one of base 21 is composed of a magnetized material and the other of bar 19 and base 21 is composed of a magnetically responsive material. In the illustrated embodiment base 21 includes a magnetic portion and bar 19 is steel. Magnet 19 is supported on a block 18 which is mounted on carriage 11. The upper surface of magnet 19 is disposed at an elevation which is at least as high as the top of the cover 17 so that when removable toy 20 having base 21 therebeneath is placed upon the magnet 19, it does not interferre with the battery cover 17. As shown in FIG. 5, such toy 20 can represent an animal or any other happy figure that pleases a child.

The carriage 11 is attached by means of a single pivot pin 22 to one end of an elongated stick 23 and which at its opposite extreme end forms a handle 24 for being grasped in the hands of a child. Near the handle 24 there is a steering wheel 25 rigidly secured to a turning shaft or winch 26 and which are rotatable about a pin 27 mounted upon the stick 23. A pair of nylon cables 28 are each wound up at their own ends upon the winch 26, the nylon cables extending therefrom through an eye bolt 29 mounted upon a lower end of the stick 23, and the terminal ends of the nylon cables are then attached at 30 near opposite side edges of the carriage 11 so that when the steering wheel 25 is rotated in one direction, the carriage turns in that particular direction, and when the steering wheel is turned in an opposite direction, the carriage turns likewise opposite, thus rotation of the steering wheel causes the carriage to be steered into any desired direction.

The switch 31 of the electric circuit is mounted on the stick 23 and includes a push button 32 that is located on the steering wheel 25 so that a child can readily reach the same in order to close the electrical circuit in order that the electromagnet is activated for magnetically attracting other objects that are of steel or cooperative magnet material.

Figure 4:
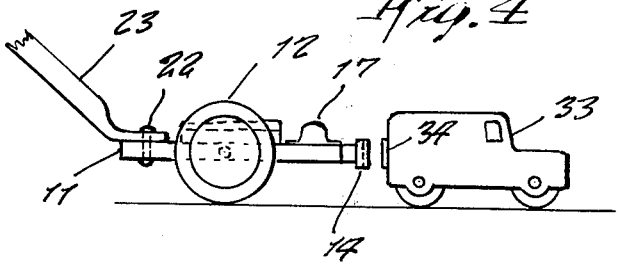
FIG. 4 is a fragmentary side elevation view of the invention and shown in position for magnetically attracting a vehicle toy for pushing the same.

As shown in FIG. 4, the present invention can include or be associated with vehicle toys 33 of various design and which upon their rear end have a magnetically cooperative member 34, for example a steel bar, for being attracted by the electromagnet 15.

In operative use, by pushing the push button 32, the electromagnet 15 is activated so that when positioned against the rear end of the toy vehicle 33, the cooperative member 34 is attracted to magnet 15 and thus is pushed by the push toy 10. Thus the toy vehicle 33 can be pushed into any desired direction as the child controls the steering wheel 25.

This toy will give the child the delight of driving his friends imaginatively carried within the toy vehicle or else in the form of dolls or other toys 20 that are positioned on the magnet 19.

The push toy can be made in any of various different attractive colors so as to appeal visually to children.

While various changes may be made in detailed construction, it is understood that such changes will be within the spirit and scope of the present invention as defined in the present claims.

What is claimed is:

1. A toy combination comprising a push toy and a removable toy, said push toy including a carriage, a pair of wheels rotatably mounted to said carriage, said wheels supporting said carriage, a control stick pivotally mounted to said carriage, at least a portion of said stick constituting a handle, steering means mounted to said stick and connected to said carriage, said steering means providing relative movement between said stick and said carriage, and means for magnetically attaching said removable toy and said push toy.

2. The push toy as claimed in claim 1 wherein said means for magnetically attaching includes a magnetic member and a magnetically responsive member, one of said magnetic member and said magnetically responsive member mounted to said carriage and the other of said magnetic member and said magnetically responsive member mounted to said other toy.

3. The push toy as claimed in claim 2 wherein said magnetic member is a magnet and said magnetically responsive member is composed of steel.

4. The push toy as claimed in claim 3 wherein said magnet is mounted to said carriage and said magnetically responsive member is mounted to said other toy.

5. The push toy as claimed in claim 3 wherein said magnet is mounted to said other toy and said magnetically responsive member is mounted to said carriage.

6. A toy combination comprising a push toy and a removable toy, said push toy and said removable toy including magnetically cooperating means for mounting said removable toy on said push toy, said magnetically cooperating means including magnet means and magnetically responsive means; said push toy including a carriage, a pair of wheels rotatably mounted to said carriage for supporting said carriage, a control stick extending from said carriage, one end of said control stick pivotally mounted to said carriage, an opposite end of said control stick defining a handle, a steering wheel rotatably mounted to said control stick, cable means attached to said steering wheel and said carriage, rotation of said steering wheel causing said carriage to turn relative to said control stick, one of said magnet means and said magnetically responsive means mounted to said carriage, the other of said magnet means and said magnetically responsive means mounted to said removable toy.

7. The toy combination as claimed in claim 6 wherein said push toy includes an electromagnet mounted to said carriage at a forward portion thereof, said electromagnet having energized and deenergized states; and means for energizing said electromagnet for magnetically coupling a toy to said carriage.

8. The toy combination as claimed in claim 7 wherein said means for energizing includes a switch having ON and OFF states and at least one battery, said battery connected to said electromagnet through said switch, an electrical path established between said electromagnet and said battery when said switch is in said ON state, said electromagnet in said energized state when said switch is in said ON state, said electromagnet electrically disconnected from said battery when said switch is in said OFF state, said electromagnet magnetically coupling a toy to said carriage only when said electromagnet is in said energized state.

9. The toy combination as claimed in claim 7 wherein said magnet means is a magnet mounted to said carriage and wherein said magnetically responsive means is a steel member mounted to said removable toy, said magnet and steel member magnetically cooperating to hold said removable toy on said carriage.

10. The toy combination as claimed in claim 7 wherein said magnet means is a magnet mounted to said removable toy and wherein said magnetically responsive means is a steel member mounted to said carriage, said magnet and steel member magnetically cooperating to hold said removable toy on said carriage.

11. A toy combination comprising a push toy and a removable toy, said push toy and said removable toy including magnetically cooperating means for attaching said removable toy to said push toy, said magnetically cooperating means including magnet means and magnetically responsive means; said push toy including a carriage, a pair of wheels rotatably mounted to said carriage for supporting said carriage, a control stick pivotally mounted to and extending from said carriage, at least a portion of said control stick defining a handle, steering means mounted to said control stick, cable means attached to said steering means and said carriage, movement of said steering wheel causing relative movement of said carriage and said control stick, one of said magnet means and said magnetically responsive means mounted to said magnet means and said magnetically responsive means mounted to said carriage, the other of said magnet means and said magnetically responsive means mounted to said removable toy.

* * * * *